US005976039A

United States Patent [19]

Epel et al.

[11] Patent Number: 5,976,039

[45] Date of Patent: Nov. 2, 1999

[54] ADJUSTABLE BALL COURT SYSTEM AND METHOD FOR HANDICAPPING A CONTEST

[76] Inventors: Joseph N. Epel, 3811 Spanish Oaks Dr., Orchard Lake, Mich. 48323; Herman Foster, 6876 Wing Lake Rd., Bloomfield, Mich. 48301

[21] Appl. No.: 08/967,660

[22] Filed: Nov. 10, 1997

[51] Int. Cl.[6] ..... A63B 61/00

[52] U.S. Cl. ..... 473/490

[58] Field of Search ..... 473/473, 463, 473/475, 479, 490, 496, 469, 470, 471, 472, 474, 466, 492, 430, 491, 445, 612; 124/5; 273/317.3, 393

[56] References Cited

U.S. PATENT DOCUMENTS

| | | | |
|---|---|---|---|
| 454,700 | 6/1891 | Baker | 473/491 |
| 3,388,909 | 6/1968 | Woods | 473/472 |
| 3,544,109 | 12/1970 | Woods | 473/472 |
| 3,819,182 | 6/1974 | Lersch | 473/491 |
| 3,968,968 | 7/1976 | Peterson | 473/493 |
| 3,980,299 | 9/1976 | Brown | 473/494 |
| 4,010,951 | 3/1977 | Gronlund | 473/492 |
| 5,139,256 | 8/1992 | Logan | 473/492 |

*Primary Examiner*—Jessica J. Harrison
*Assistant Examiner*—Shelia Clayton
*Attorney, Agent, or Firm*—Herman Foster

[57] ABSTRACT

A system and method for handicapping a ball game such as tennis or volleyball between opponents of lesser and greater skills, by varying or moving at least one of the parameters of the court on which the game is played, a sufficient amount to balance the disparity in such skills. The parameters described are the net, and court boundary lines which may be defined by electric luminescent tape embedded in, or fastened to, the surface of the court floor in parallel spaced lines which selectively can be lit to define the desired boundary, or, may be defined by projected lines on or adjacent to the floor from narrow beam or laser beam projectors capable of projecting lines at desired locations either from overhead or at floor level.

13 Claims, 2 Drawing Sheets

ADJUSTABLE BALL COURT SYSTEM AND METHOD FOR HANDICAPPING A CONTEST

TECHNICAL FIELD

This invention relates to a ball court system and method by which at least one of the controlling parameters of the court can be adjusted to permit players or contestants of unequal abilities to compensate for such inequality and thus increase the competition between such players or contestants.

BACKGROUND

In games such as tennis, people who have developed a high level of skill in their game will with the passage of time find that their physical abilities begin to diminish so that ultimately it is impossible to maintain the skill level that they had at their peak. If players are not closely matched in skills, an exciting, competitive game cannot be played. Close friends, or married couples, or business associates who would like to enjoy a dynamic, competitive game such as tennis cannot play such a game if their skills do not match. As a result such people will either limit their play to "rallying" or "volleying" or playing against someone of greater skill and physical capacity when they are given a significant point handicap. However, even under the latter arrangement the thrill of a closely played match, where each opponent extends oneself to the limit to win, is missing. Using a point handicap in golf can provide a gratifying contest because in such a game each contestant is really playing primarily against his/her self. But on the ball courts covered by this invention a point handicap can often prove unsatisfactory because the better player is not tested by the handicap to improve his/her game but rather to make up for the deficiency in the score and merely tries to score more quickly until he/she has won.

The lesser skilled player is not tested by such a handicapping system because with points granted under the system the game for that individual will not normally be as long in duration as one would be if the skills of the players could be balanced, thus achieving a more interesting and competitive contest.

It is an object of this invention to adjust at least one characteristic parameter of the playing court, i.e., a rear boundary line or the net location, through the use of readily adjustable mechanical means or by controlling the location of such lines by such defining means as lasers, narrow light beams or electrically luminescent tape, or their equivalents. Such physical adjustments can offer a more competitive environment of play than an adjustment in the scoring.

Patents exist dealing with portable or movable boundaries for games or courts. See for example, U.S. Pat. No. 3,968,968 (Mini-Volleyball Court Layout); U.S. Pat. No. 3,985,359 (Portable Sports Court Bounday); U.S. Pat. No. 4,352,497 (Mobile Goals). However, it is considered that such art does not encompass providing a suitable handicap by modifying a ball court to favor the lesser opponent to the extent necessary to provide an even contest or match between two players, or two contestant groups, of unequal skill.

SUMMARY

A feature of the present invention is its applicability to a variety of ball courts. While the preferred embodiment deals with with tennis courts and will be described hereafter in greater detail, other sports, such as volley ball, or table tennis (ping pong), to name a few, can apply the principles of this invention.

In tennis, to permit the weaker player to play more equally with a better player, one of the characteristic parameters, such as the location of the net, may be changed, i.e., moved toward the weaker player, to diminish the amount of ground this weaker player must defend and give this weaker player a larger target territory to hit into. It simultaneously offers the stronger player an increased challenge to hit and maintain the ball within the bounds of his opponent's diminished side of the net and defend the increased space on his/her's side of the net. Thus, the stronger player gets an increased level of competition than might normally be the case from a simple point adjustment handicap. An alternative means of altering the size of the weaker player's side of the net is to move the service line and rear boundary line, or base line, toward the net a predetermined distance. Since this would affect only one side of the court the stronger player's side would retain its original dimensions. This type of alteration offers an approach that gives a less dramatic effect to the playing court than does movement of the net. Since the players change sides during the game of tennis it is necessary to have the movement of the net or service and boundary lines readily available on either side of the net. Therefore, changing the location of the net or the lines should not be an act requiring extensive time or skills of the players to accomplish.

Movement of the net may be achieved through the use of parallel screw drives driven by hand or by a pair of synchronized electric motors, or by pneumatic or hydraulic drives, to move the supporting poles of the net any prescribed distance toward either end of the tennis court. The service and boundary lines of the court may be defined either by movable light projectors to mark the line locations on the floor, or by a plurality of electrically luminescent tapes, in or on the floor, any one or more of which may be lighted up to define the desired line(s). By either means the the court may be adjusted to compensate for the differences in the capabilities of the players.

Likewise, similar adjustments to the court parameters can be made in the game of volley ball, by either moving the net or a spiking line and/or rear boundary line.

On a smaller scale the same principles may be applied to the game of ping pong in which the net may be moved a preselected distance to either side of the center of the ping pong table. As in the game of lawn tennis, the ping pong table court may be altered or adjusted to match up play between players of disparate abilities.

It is to be understood that the weaker player is not the only one to benefit from these court adjustments in his/her favor. Properly made, the adjustments will also benefit the stronger player who will have to use all his/her skills and play at his/her peak to overcome the oponent's given advantages. This negates any bad habits that could arise from sloppy play that might occur by playing just good enough to win over a point handicap under current practices. It is also to be underestood that since net games, as described herein, are not necessarily limited to "singles" players, but may have "doubles" opponents, or, as in volley ball, numerous players (three or more ) on each side, the terms "player", "contestant" or other singular references to opponents, as used herein, may be applicable to the plural as well as the singular.

DETAILED DESCRIPTION

Figure 1:
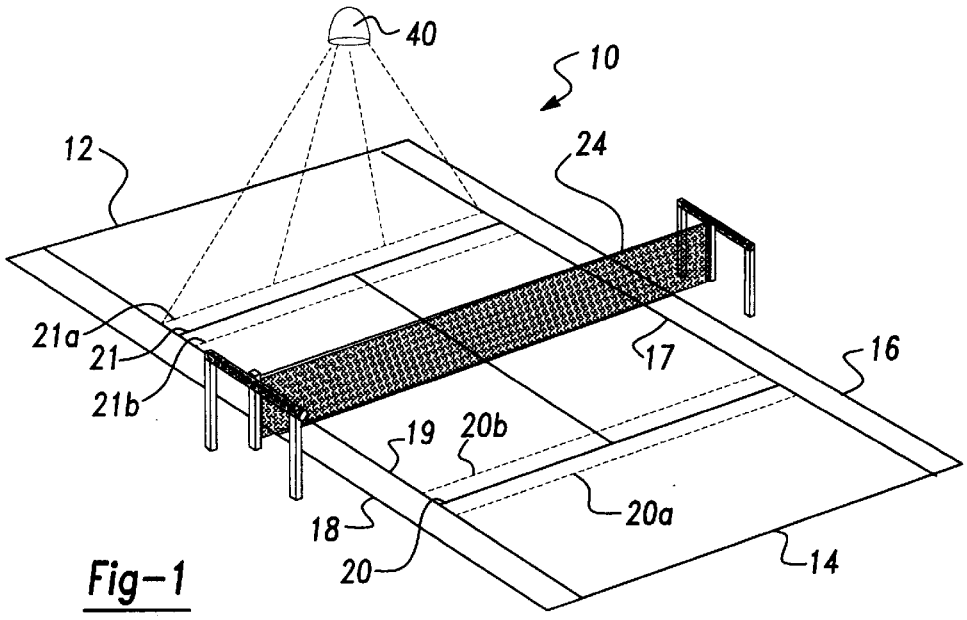
FIG. 1 is an isometric of one form of a tennis court containing an application of a variation of the invention.
Figure 2:
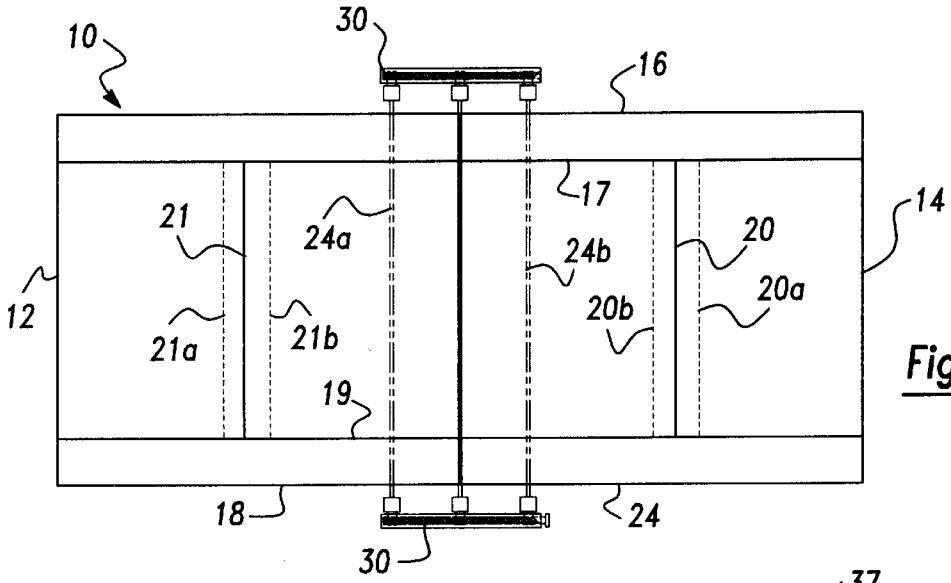
FIG. 2 is a plan view of the court of FIG. 1.

Referring now to FIGS. 1 and 2, there is shown a tennis court 10 with base lines 12 and 14, doubles sidelines 16 and 18, singles sidelines 17 and 19, and service lines 20 and 21. Across the center portion of the court 10 is a movable net 24 movably supported by a support structure generally designated 30.

Figure 3:
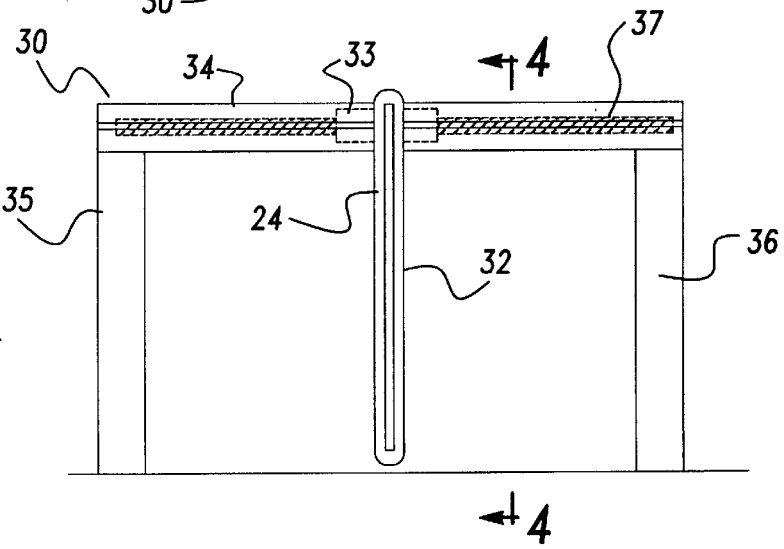
FIG. 3 is a schematic elevation view of the of the net moving mechanism at one end of the net shown inFIGS. 1 and 2.
Figure 4:
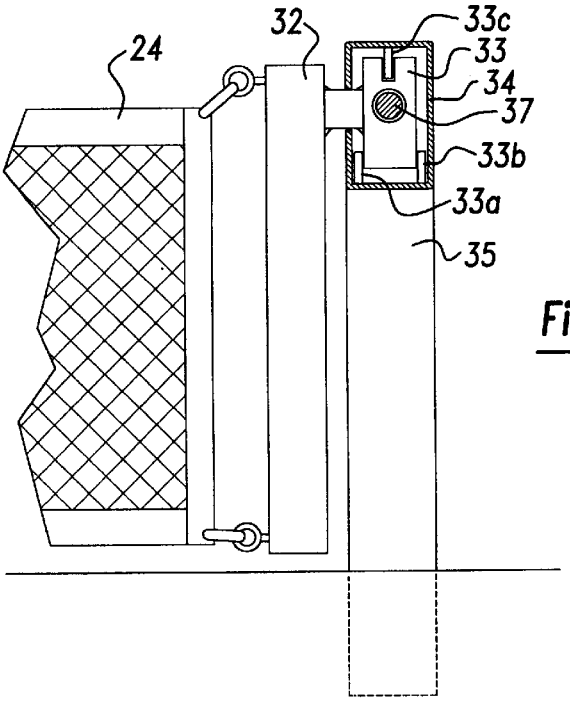
FIG. 4 is an enlarged cross-section taken along line 4—4 of FIG. 3.

Referring to FIGS. 3 and 4, it will be seen that the net 24 is appropriately fastened at each end to a movable end post 32 joined to, and supported by, a carrier member 33 riding on wheels 33*a*,33*b*, and 33*c*. The carrier member 33 is contained within a structural channel member 34, fastened to and supported at each end by posts 35 and 36. Also contained within the channel member 34 is a drive mechanism for the carrier member 33, which is shown in this embodiment as a screw drive 37, to move the carrier member 33 from one of channel member 34 tothe other end. Each screw drive 37 may be hand driven or power driven by means such as an electric motor. If the latter, it is desirable to have the electric motors which drive the screw devices at each end of the net 24 coordinated so as to prevent excessive skewing of the net 24. It may be desirable to move the net between support posts 35 and 36 by such other means as hydraulic or pneumatic drives or by a chain drive. Therefore, the specifics of net transporting alternatives are considered unnecessary to an understanding of the invention.

Another form of charactristic parameter control for the embodiment of FIGS. 1 and 2 is relocation of one or more of the service and/or base lines. For example, the location of service line 21*a* could be moved either to an outside location 21*a* or an inside location 21*b* by projecting a narrow light beam, such as a laser beam, to define the line. Projector 40 is a schematic illustration of such a projector in an overhead location. As an alternative to overhead projection, narrow light beams, such as laser beams, may be projected horizontally in close proximity to the court surface to define the appropriate court parameters. If an alternate or supplement to any of the above described projectors, such as 40, are desired for the site on which the tennis court 10 is located, any of the lines, such as the service or base lines may be defined by suitable cables or wires or electric luminescent tape embedded in, or fastened to, the surface of the court floor, in parallel spaced lines which selectively can be lit to define the desired boundary location. For example, to relocate service line 20 to 20*a* or 20*b* can be accomplished by defining these lines with such tapes embedded in the court surface or unobtrusively fastened to the surface and selectively lighting the tape at the location chosen to be the appropriate boundary. Base lines 12 and 14 may be moved and defined in the same manner as the above described service lines. The specific mechanical steps to put the foregoing line defining operations into practice are not considered necessary to the description of the claimed invention.

Figure 5:
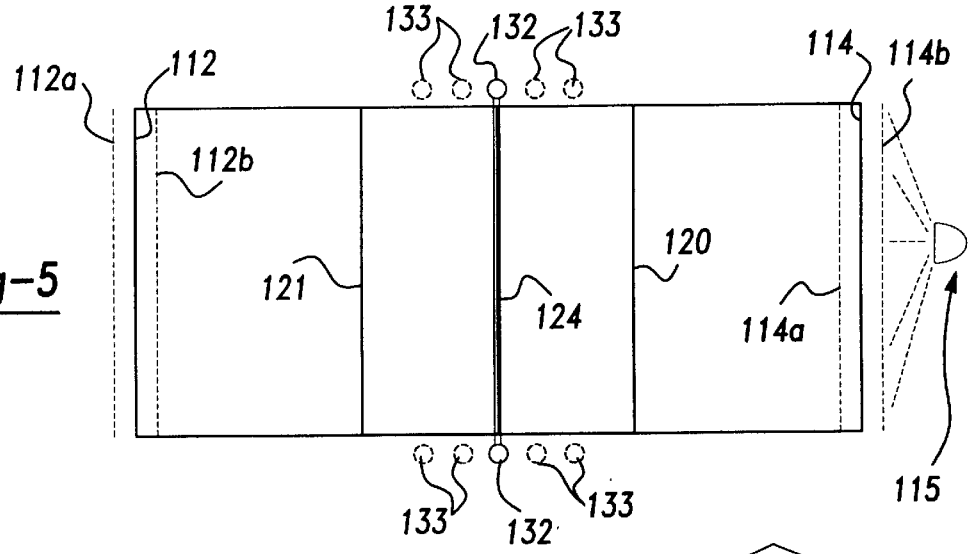
FIG. 5 is a plan view of a volleyball court illustrating a variation of the invention.

In FIG. 5 is shown a typical volleyball court 110 as seen from above, across which is stretched a net 124 between two suporting poles 132. While it is technically possible to shift the net 124 toward either of the spiking lines 120 and 121 by powered means, it is currently considered economically more desirable and advantages to have poles 132 manually lifted and relocated to any opposed pair of retaining tubes 133 embedded in the surface adjacent the court 110. As with the tennis court of FIGS. 1 and 2, the rear boundary lines 112 and 114 can be shifted as desired to locations as shown by lines 112*a*, 112*b* and 114*a*, 114*b* defined by narrow light beams projected on the floor surface by a projector such as that shown schematically at 115, or horizontally in close proximity to the floor, or by cables or wires or luminescent tape fastened and lighted as described above.

Figure 6:
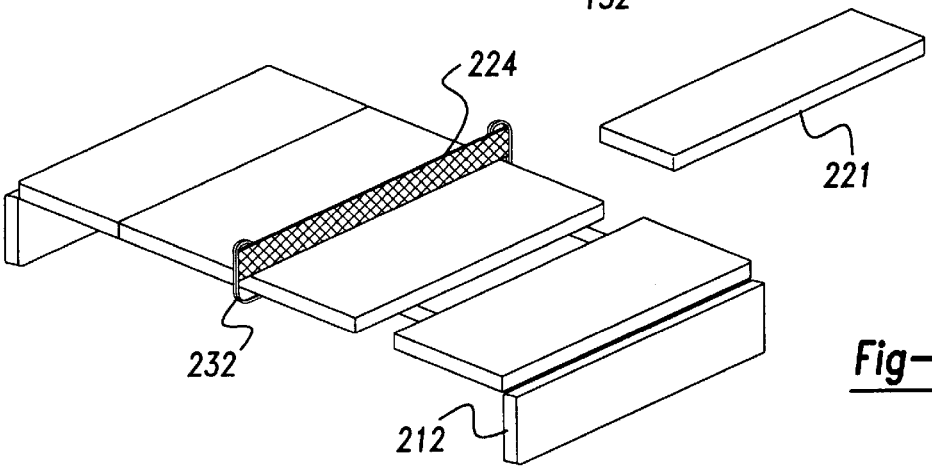
FIG. 6 is an isometric of a table-top court for table tennis showing two forms of court modification.

Shown in FIG. 6 is an embodiment relating to table tennis, or ping pong, as it is also known. In this embodiment the net 224 fastened by a releasable clamp 232 to a ping pong table 210 may be moved toward one end of the table 210 or the other. If necessary, one end of the table may be extended, thus enlarging that portion of the court, either by lifting a drop leaf 212 into place, or by inserting a table leaf 221. These are similar to table extensions used on standard extendable dining room tables. By such means the stronger player can be tested more intensely by having more table to defend and a smaller and/or more distant target to play into as would occur in a lawn tennis contest played with a court as in the embodiment of FIGS. 1 to 4. A difference between this variation and that of FIGS. 1 to 4 is that in FIG. 6, boundary lines are normally delineated at the table edges to define the extent of the court played on.

The preferred variation of the invention is that shown in FIGS. 1 to 4. If two players of disparate skills desire to play each other and make their match an exciting competitive contest, they can agree on their relative strengths and weaknesses and determine whether to move either the net 24 or the service lines 20 and 21, or both the lines and the net. to make up for the disparate skills of the players. Should movement of the net only be considered appropriate it has been considered desirable to limit such movement in either direction to an approximate maximum of 3 feet in either direction from the centered net position. These extreme positions are designated as 24*a* and 24*b* in FIG. 2. It is recognized that if movement of the net 24 of more than 3 feet from the center is required to balance out disparate skills of the players the balance can be further accomplished by moving either or both service and base lines. The limit of 3 feet has the salutary effect of keeping the support structure 30 from becoming a major engineering feat. Thus it is understood that the approximate 3 feet limit is not a limit on the invention as claimed but rather a recognition of what may be currently most practical in the practice of the invention.

While the best mode for carrying out the invention has been presented in the foregoing description, it will be understood that various changes may be made within the scope of the invention without departing from its true spirit and scope. For example, the invention is adaptable to sports, other than the tennis and volleyball games described above, such as badminton. Therefore, it is intended that the scope of the invention be defined only by the claims below.

What is claimed is:

1. A court for a ball game having a playing surface on which two sides of opposing contestants are positioned for movement on said playing surface, said court comprising: a width defined at said playing surface by two opposed parallel side boundary lines, a length defined at said playing surface by two opposed parallel end boundary lines, a net extending across said width between and parallel to said end boundary lines and between the positions of said opposing contestants, and two additional service lines located parallel to and between said end boundary lines and being on each side of, and spaced from, said net; said end boundary lines, said two additional lines and said net being characteristic parameters and the location of each such parameter being movable toward and away from the other parameters so that relocation of at least one of said parameters in relation to the other said parameters will alter the playing surface length of said court on one side of said net relative to the playing surface length on the other side of said net and thus redefine the overall playing surface to favor one contestant side more than the other contestant side according to a prearranged assessment of the relative skills of said contestants.

2. A lawn tennis court having a playing surface on which two sides of opposing contestants are positioned for movement on said playing surface, said court comprising: a width defined at said playing surface by two opposed parallel side boundary lines, a length defined at said playing surface by two opposed parallel end boundary lines, a net extending across said width parallel to said end boundary lines and between the positions of said opposed contestants and supported at each end of said net by a post movably supported to move exteriorly of and parallel to said side boundary lines, and two parallel service lines, one on each side of said net between said net and the end boundary line on the same side of the net, said each of said end boundary lines, service lines and net being essential parameters movable with respect to each other, so that relocation of at least one of said parameters in relation to the other of said parameters will alter the playing surface length of said court on one side of said net relative to the playing surface length on the other side of said net and thus redefine the overall playing surface to favor one contestant side more than the other contestant side according to a prearanged assessment of relative skills of said contestants.

3. A court as called for in claim 2, wherein, said end boundary lines and service lines are defined by light sources.

4. A court as called for in claim 3, wherein, said light sources are narrow line light projectors oriented as overhead projectors defining lines on the playing surface of said court.

5. A court as called for in claim 3 wherein said light sources are narrow line light projectors oriented horizontally to generate lines in close proximity to the playing surface of the court.

6. A court as called for in claim 3 wherein said light sources are light luminescing strips fastened to said playing surface.

7. A court as called for in claim 3 wherein said light sources are a plurality of light luminescing strips embedded in said playing surface.

8. A court as called for in claim 2 wherin said net is is fastened to a post at each end, said posts being joined to movable carriers supported by said playing surface exteriorly of said side boundary lines.

9. A court as called for in claim 2 wherein said net is fastened to a post at each end, said posts being movable from one to another of a plurality of sockets embedded in said playing surface and located exteriorly of and parallel to said side boundary lines.

10. A method of handicapping a ball game between two opponents with lesser and greater skills, played on a court having end and side boundaries and a net stretched across the court normally midway between the end boundaries, comprising the step of, modifying the area of the court on one side of the net to be defended by the opponent with lesser skills relative to the area of the court on the other side of said net to be defended by the opponent with the greater skills, in proportions estimated to balance the disparity in skills of the opponents.

11. A method as called for in claim 10, step of modifying of the court area is accomplished by moving the net toward the end to be defended by the lesser skilled opponent.

12. A method as called for in claim 10, wherein, the area on said one side of said net is altered relative to the area on said other side of said net by relocating at least one of said end boundaries as determined by the said estimated proportions.

13. A method as called for in claim 10 wherein said court further contains service lines within said end boundary lines parallel to, and located one on each side of, said net, and wherein said area on one side of said net is modified relative to the area on said other side of said net by relocating at least one of said service lines as determined by the said estimated proportions.

* * * * *